US006283575B1

(12) United States Patent
Hawkins et al.

(10) Patent No.: US 6,283,575 B1
(45) Date of Patent: Sep. 4, 2001

(54) INK PRINTING HEAD WITH GUTTER CLEANING STRUCTURE AND METHOD OF ASSEMBLING THE PRINTER

(75) Inventors: Gilbert A. Hawkins, Mendon; John R. Debesis, Penfield; James M. Chwalek, Pittsford, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/307,876

(22) Filed: May 10, 1999

(51) Int. Cl.[7] ..... B41J 2/165
(52) U.S. Cl. ..... 347/28; 347/27
(58) Field of Search ..... 347/25, 27, 28

(56) References Cited

U.S. PATENT DOCUMENTS

| | | | | |
|---|---|---|---|---|
| 4,528,996 | * | 7/1985 | Jones | 347/28 |
| 4,600,928 | | 7/1986 | Braun et al. | 347/27 |
| 4,849,769 | * | 7/1989 | Dressler | 347/28 |
| 4,970,535 | | 11/1990 | Oswald et al. | 347/25 |
| 5,412,411 | * | 5/1995 | Anderson | 347/28 |
| 5,574,485 | | 11/1996 | Anderson et al. | 347/27 |
| 5,877,788 | * | 3/1999 | Haan et al. | 347/28 |
| 5,929,877 | * | 7/1999 | Hetzer et al. | 347/28 |

FOREIGN PATENT DOCUMENTS

| | | | | |
|---|---|---|---|---|
| 3917720 | | 11/1989 | (DE) . | |
| 0749836 | | 5/1996 | (EP) . | |
| 1016532 | | 5/2000 | (EP) . | |
| 58096563 | | 8/1983 | (JP) . | |
| 361193857 | * | 8/1986 | (JP) | 347/28 |
| 404039055 | * | 2/1992 | (JP) | 347/28 |

OTHER PUBLICATIONS

European Search Report completed Aug. 4, 2000 EP 00 20 1541.
Annex to the European Search Report completed Aug. 4, 2000 EP 00 20 1541.

* cited by examiner

*Primary Examiner*—N. Le
*Assistant Examiner*—Shih-Wen Hsieh
(74) *Attorney, Agent, or Firm*—Walter S. Stevens

(57) ABSTRACT

Ink printing printer with gutter cleaning structure and method of assembling the printer. The printer includes a print head (10) having a surface (14) thereon, the surface (14) including an orifice region (18) having at least one ink-ejection orifice (16), a first gutter (22) disposed proximate one side of the orifice region (18) adapted for connection to a source of a cleaning fluid, and a second gutter (24) disposed proximate an opposite side of the orifice region (18) adapted for connection to a receiver for the cleaning fluid. A cover member (40) is positionable opposite the orifice region (18) and the gutters (22,24) for forming a sealed enclosure (42) thereof defining a cavity (44) sized to allow fluid flow therethrough from the first gutter (22) over the orifice region (18) to the second gutter (24). A pump (36) is provided, preferably integrally formed in the print head (10), and connected to the gutters (22, 24) through channels (28, 30, 32, 34) in the print head (10) substrate for the circulation of the cleaning fluid. A filter (38) can also be provided between one of the gutters (22, 24) and the pump (36) for removing contaminants from the cleaning fluid. A source of acoustic energy (54) can also be provided for exciting the cleaning fluid as the cleaning fluid flows through the cavity (44) for facilitating the cleaning action.

23 Claims, 1 Drawing Sheet

INK PRINTING HEAD WITH GUTTER CLEANING STRUCTURE AND METHOD OF ASSEMBLING THE PRINTER

BACKGROUND OF THE INVENTION

This invention generally relates to ink jet printer apparatus and methods and more particularly relates to a self-cleaning ink jet print head including a gutter cleaning structure for directing cleaning fluid over a surface of the print head and ink-ejecting orifices thereon and collecting the fluid and contaminants contained therein, and a method of assembling the printer.

An ink jet printer produces images on a receiver by ejecting ink droplets onto the receiver in an imagewise fashion. The advantages of nonimpact, low-noise, low energy use, and low cost operation in addition to the capability of the printer to print on plain paper are largely responsible for the wide acceptance of ink jet printers in the marketplace.

In this regard, "continuous" ink jet printers utilize electrostatic charging tunnels that are placed close to the point where ink droplets are being ejected in the form of a stream. Selected ones of the droplets are electrically charged by the charging tunnels. The charged droplets are deflected downstream by the presence of deflector plates that have a predetermined electric potential difference between them. A gutter may be used to intercept the charged droplets, while the uncharged droplets are free to strike the recording medium.

In the case of "on demand" ink jet printers, at every orifice a pressurization actuator is used to produce the ink jet droplet. In this regard, either one of two types of actuators may be used. These two types of actuators are heat actuators and piezoelectric actuators. With respect to heat actuators, a heater placed at a convenient location heats the ink and a quantity of the ink will phase change into a gaseous steam bubble and raise the internal ink pressure sufficiently for an ink droplet to be expelled to the recording medium. With respect to piezoelectric actuators, a piezoelectric material is used, which piezoelectric material possesses piezoelectric properties such that an electric field is produced when a mechanical stress is applied. The converse also holds true; that is, an applied electric field will produce a mechanical stress in the material. Some naturally occurring materials possessing these characteristics are quartz and tourmaline. The most commonly produced piezoelectric ceramics are lead zirconate titanate, barium titanate, lead titanate, and lead metaniobate.

Inks for high speed ink jet printers, whether of the "continuous" or "piezoelectric" type, must have a number of special characteristics. For example, the ink should incorporate a nondrying characteristic, so that drying of ink in the ink ejection chamber is hindered or slowed to such a state that by occasional spitting of ink droplets, the cavities and corresponding orifices are kept open. The addition of glycol facilitates free flow of ink through the ink jet chamber. Of course, the ink jet print head is exposed to the environment where the ink jet printing occurs. Thus, the previously mentioned orifices are exposed to many kinds of air born particulates. Particulate debris may accumulate on surfaces formed around the orifices and may accumulate in the orifices and chambers themselves. That is, the ink may combine with such particulate debris to form an interference burr that blocks the orifice or that alters surface wetting to inhibit proper formation of the ink droplet. The particulate debris should be cleaned from the surface and orifice to restore proper droplet formation. In the prior art, this cleaning is commonly accomplished by brushing, wiping, spraying, vacuum suction, and/or spitting of ink through the orifice.

Thus, inks used in ink jet printers can be said to have the following problems: the inks tend to dry-out in and around the orifices resulting in clogging of the orifices; and the wiping of the orifice plate causes wear on plate and wiper, the wiper itself producing particles that clog the orifice.

Ink jet print head cleaners are known. An ink jet print head cleaner is disclosed in U.S. Pat. No. 4,970,535 titled "Ink Jet Print Head Face Cleaner" issued Nov. 13, 1990, in the name of James C. Oswald. This patent discloses an ink jet print head face cleaner that provides a controlled air passageway through an enclosure formed against the print head face. Air is directed through an inlet into a cavity in the enclosure. The air that enters the cavity is directed past ink jet apertures on the head face and then out an outlet. A vacuum source is attached to the outlet to create a subatmospheric pressure in the cavity. A collection chamber and removable drawer are positioned below the outlet to facilitate disposal of removed ink. Although the Oswald patent does not disclose use of brushes or wipers, the Oswald patent also does not reference use of a liquid solvent to remove the ink; rather, the Oswald technique uses heated air to remove the ink. However, use of heated air is less effective for cleaning than use of a liquid solvent. Also, use of heated air may damage fragile electronic circuitry that may be present on the print head face. Moreover, the Oswald patent does not appear to clean the print head face in a manner that leaves printing speed unaffected by the cleaning operation.

Another ink jet print head cleaner is disclosed in U.S. Pat. No. 4,600,928 by Braun et al. The patent teaches an ink jet printing apparatus which comprises an ultrasonic self cleaning system for cleaning of the print head assembly in which ink is supported in approximation to the orifices of the print head surface by means such as the capillary force. Ultrasonic cleaning pulses are then applied to clean the surface through fluid transmission of ultrasound energy to the surface. However, this invention requires direct fluid communication between ink and the print head surface for cleaning purposes and it uses ink and not a more effective cleaning solvent for that purpose.

Another ink jet print head cleaner is disclosed in U.S. Pat. No. 5,574,485 by Anderson et al. The Anderson patent teaches an ultrasonic liquid wiper for cleaning of a print head surface in which cleaning fluid is brought into close contact with the print head surface by the aid of a cleaning station. Ultrasonic energy in conjunction with the cleaning fluid are then used to dislodge dried ink particles from the print head surface, where they are removed using vacuum nozzles. However, this invention requires a relatively complex cleaning station including apparatus for scanning the liquid wiper across the print head surface.

Therefore, there is a need to provide a self-cleaning printer which provides effective cleaning without limitations relating to print head surface wear, ink contact, or complex cleaning station apparatus, and a method of assembling the printer.

SUMMARY OF THE INVENTION

An object of the present invention is to provide a self-cleaning printer which provides effective cleaning without limitations relating to print head surface wear, ink contact, or complex cleaning station apparatus, and a method of assembling the printer.

With this object in view, the present invention resides in a self-cleaning printer, comprising a print head having a surface thereon, the surface including an orifice region having at least one ink-ejection orifice, a first gutter disposed proximate one side of the orifice region adapted for connection to a source of a cleaning fluid, and a second gutter disposed proximate an opposite side of the orifice region adapted for connection to a receiver for the cleaning fluid; and a cover member positionable opposite the orifice region and the gutters for forming a sealed enclosure thereover defining a cavity sized to allow fluid flow therethrough from the first gutter over the orifice region to the second gutter.

According to an exemplary embodiment of the present invention, the self-cleaning printer comprises a print head defining a plurality of ink channels therein, each ink channel terminating in an ink-ejection orifice. The print head also has a surface thereon including an orifice region surrounding all of the orifices. The print head is capable of ejecting ink droplets through the orifices, which ink droplets are intercepted by a receiver (e.g., paper or transparency) supported by a platen roller disposed adjacent the print head. Contaminants such as an oily film-like deposit or particulate matter may reside on the surface and may completely or partially obstruct the orifice. The oily film may, for example, be grease and the particulate matter may be particles of dirt, dust, metal and/or encrustations of dried ink. Presence of the contaminant interferes with proper ejection of the ink droplets from their respective orifices and therefore may give rise to undesirable image artifacts, such as banding. It is therefore desirable to clean the contaminant from the surface.

A feature of the present invention is the provision of a first gutter disposed proximate one side of the orifice region adapted for connection to a source of cleaning fluid, and a second gutter disposed proximate an opposite side of the orifice region adapted for connection to a receiver for the cleaning fluid.

Another feature of the present invention is the provision of a cover member disposed opposite the orifice region and the gutters for forming a sealed enclosure thereover defining a cavity for the flow of cleaning fluid from the first gutter over the orifice region to the second gutter for removing contaminants from the surface and/or orifices.

Another feature of the present invention is the provision of a pump integrally formed in the print head connected to the gutters through fluid flow channels in the print head substrate for the circulation of the cleaning fluid. A filter can also be provided between one of the gutters and the pump for removing contaminants.

Another feature of the present invention is the provision of a source of acoustic energy for exciting the cleaning fluid as the cleaning fluid flows through the cavity for facilitating the cleaning action.

As an advantage of the present invention, the gutters and channels for the cleaning fluid are incorporated into the print head, and close alignment of the cover member with the print head is not required, thus avoiding the need for complex cleaning station apparatus.

As another advantage, the cleaning is accomplished without contacting the surface within the orifice region, thus avoiding potential damage to delicate aspects of the print head, such as exposed heaters and the like.

According to the invention, any liquid that does not significantly damage the print head can be used as a cleaning fluid. For example, water, isopropanol, diethylene glycol, diethylene glycol monobutyl ether, octane, acids and bases, surfactant solutions and any combination thereof may be used as cleaning fluids. Complex fluids such as microemulsions, micellar surfactant solutions, vesicles and solid particles dispersed in liquids may also be used as cleaning fluids.

These and other objects, features and advantages of the present invention will become apparent to those skilled in the art upon a reading of the following detailed description when taken in conjunction with the drawings wherein there are shown and described illustrative embodiments of the invention.

BRIEF DESCRIPTION OF THE DRAWINGS

While the specification concludes with claims particularly pointing out and distinctly claiming the subject matter of the present invention, it is believed the invention will be better understood from the following detailed description when taken in conjunction with the accompanying drawings wherein:

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
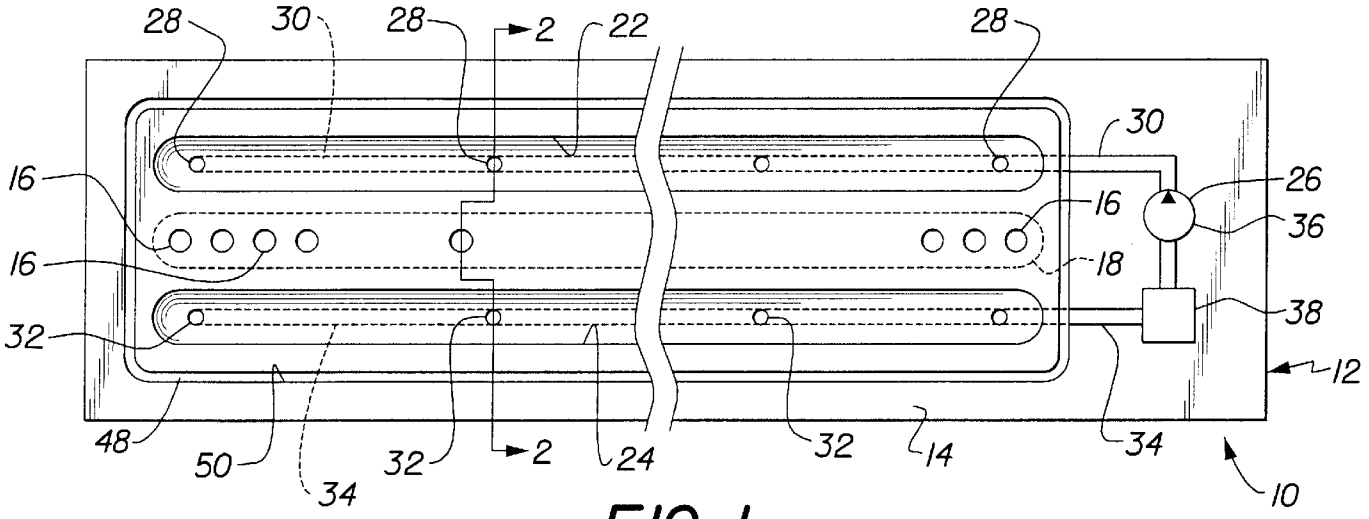
FIG. 1 is a schematic front view of a self-cleaning print head according to the present invention.
Figure 2:
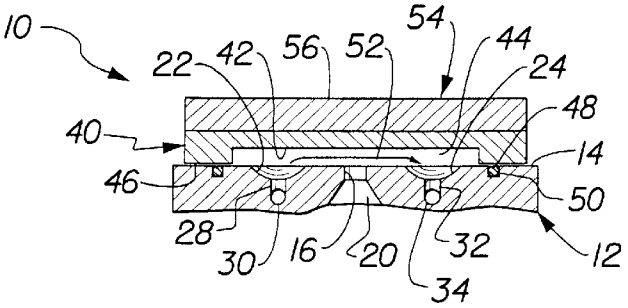
FIG. 2 is a sectional view of the print head taken along line 2—2 of FIG. 1, showing a cover member of the present invention operatively positioned thereover.

Therefore, referring to FIG. 1, an ink jet print head 10 includes a body 12 of a semiconductor material, such as, but not limited to, CMOS material. Body 12 has a front surface 14 including a plurality of ink-ejection orifices 16 therein arranged in a linear array generally defining the peripheral boundaries of an elongate orifice region 18. Referring also to FIG. 2, each ink-ejection orifice 16 extends from surface 14 through the substrate thereof to a respective ink channel 20 connected in fluid communication to a supply of ink, not shown. Print head 10 is conventionally operable to selectively eject ink contained in respective ink channels 20 through the ink-ejection orifices 16 onto a receiver such as a paper or transparency disposed opposite the orifice 16, for instance, using heating elements (not shown) located in front surface 14 which are energized to heat the ink to generate a vapor bubble.

Front surface 14 of print head 10 additionally includes a first elongate gutter 22 disposed proximate one side of orifice region 18, and an elongate second gutter 24 disposed proximate a second side of orifice region 18 opposite the first side thereof. First gutter 22 is connected in fluid communication with a source of cleaning fluid 26 via a plurality of connecting channels 28 communicating with a supply channel 30 extending through the substrate of body 12 from source 26. Second gutter 24 communicates with source 26 through a plurality of connecting channels 32 in communication with a return channel 34 extending through the substrate of body 12 to source 26. Source 26 preferably includes a microfluidic pump 36 micro machined in body 12 of print head 10, a filter 38 disposed in return channel 34 for filtering fluid flow therethrough and an optional fluid reservoir (not shown) in connection with channel 34 for supplying cleaning fluid to pump 36. Pump 36 is operable to suction or scavenge cleaning fluid from return channel 34 and pump the fluid through supply channel 30 and connecting channels 28 into first gutter 22.

Figure 3:
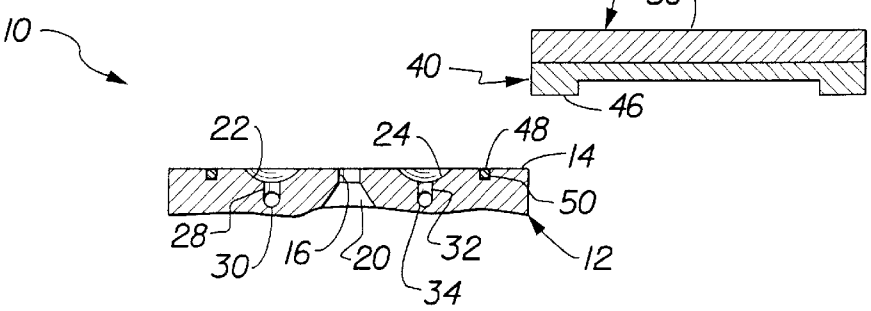
FIG. 3 is a sectional view of the print head shown in FIG. 2 with the cover member removed from the print head.

FIGS. 2 and 3 represents a section through body 12 of print head 10 along section line 2—2 in FIG. 1. FIG. 2 shows a cover member 40 positioned opposite orifice region 18 and first and second gutters 22 and 24 of surface 14 of print head 10, forming an enclosure 42 defining a cavity 44 over orifice region 18 and first and second gutters 22 and 24. Cover member 40 includes a peripheral edge 46 sealably engageable with an elastomeric seal member 48 mounted in a groove 50 extending circumferentially around orifice region 18 and first and second gutters 22 and 24 thereby sealing cavity 44. When so sealed, cavity 44 forms an enclosed path for the flow of the cleaning fluid from first gutter 22 over orifice region 18 and ink-ejection orifices 16 to second gutter 24, as denoted by arrow 52, for dislodging and/or dissolving dried ink, particulate matter, and other contaminants from orifice region 18 and orifices 16. The cleaning fluid and ink and other contaminants then flows from second gutter 24 through connecting channels 32 and return channel 34 to filter 38, which removes the contaminants. The cleaning fluid can then pass through the remainder of return channel 34 to pump 36 for recirculation to first gutter 22. FIG. 3 represents a status where the cover 40 is being moved away from the printhead 10.

To facilitate the cleaning action, a source of acoustic energy 54 can be provided adjacent cavity 44 for exciting the cleaning fluid as it flows therethrough. Preferably, source of acoustic energy 54 includes an ultrasonic transducer 56 mounted atop or on cover member 40 as shown, and is energizable and operable in a suitable conventional manner.

The cleaning fluid may be any suitable liquid solvent composition, such as water, isopropanol, diethylene glycol, diethylene glycol monobutyl ether, octane, acids and bases, surfactant solutions and any combination thereof. Complex fluids such as microemulsions, micellar surfactant solutions, vesicles and solid particles dispersed in liquid may also be used.

It may be appreciated from the description hereinabove, that cover member 40 may be separated from print head 10 while print head 10 is in a printing mode, wherein ink is selectively ejected through orifices 16 onto a recording medium, such as paper, transparencies, or the like in the usual manner. When print head 10 is not in a printing mode, cover member 40 can be brought into sealed engagement with elastomeric seal member 48 to sealably enclose orifice region 18 and gutters 22 and 24, to provide a moist environment to delay or retard drying of ink thereon, and to prevent the collection of air born particulates such as dust, fibrous material from paper and the like from collecting within orifice region 18 and contaminating same. Pump 36 can then be energized using a suitable power source for pumping the cleaning fluid into first gutter 22 and over orifice region 18 and ink-ejection orifices 16 to second gutter 24, for cleaning any ink and other contaminants therefrom.

It may be appreciated from the description hereinabove, that another advantage of the present invention is that effective cleaning of orifice region 18 and orifices 16 can be accomplished using the present apparatus without the requirement of a complex cleaning station apparatus, or the requirement of close alignment thereof with print head 10 to effect the cleaning operation. This enables greatly simplifying the cleaning apparatus and increasing the cleaning efficiency.

While the invention has been described with particular reference to its preferred embodiment, it will be understood by those skilled in the art that various changes may be made and equivalents may be substituted for elements of the preferred embodiment without departing from the invention. In addition, many modifications may be made to adapt a particular situation and material to a teaching of the present invention without departing from the essential teachings of the invention. For example, print head 10 may be of a piezoelectric or other well know conventional construction as explained herein as background and elsewhere. As another example, elastomeric seal member 48 may be alternatively located on peripheral edge 46 of cover member 40, and cover member 40 may be alternatively constructed to accommodate same.

Therefore, what is provided is a self-cleaning printer with gutter cleaning structure and method of assembling the printer.

PARTS LIST

10 . . . print head
12 . . . body
14 . . . front surface
16 . . . ink-ejection orifice
18 . . . orifice region
20 . . . ink channel
22 . . . first gutter
24 . . . second gutter
26 . . . source of cleaning fluid
28 . . . connecting channel
30 . . . supply channel
32 . . . connecting channel
34 . . . return channel
36 . . . pump
38 . . . filter
40 . . . cover member
42 . . . enclosure
44 . . . cavity
46 . . . peripheral edge
48 . . . elastomeric seal member
50 . . . groove
52 . . . arrow
54 . . . source of acoustic energy
56 . . . ultrasonic transducer

What is claimed is:

1. A self-cleaning printer comprising:

a print head having a surface thereon, the surface including an orifice region having at least one ink-ejection orifice defining an ink ejection path, a first gutter disposed on the print head proximate one side of the orifice region adapted for connection to a source of a cleaning fluid, and a second gutter disposed on the print head proximate an opposite side of the orifice region adapted for connection to a receiver for the cleaning fluid, the first and second gutters being disposed on the print head substantially perpendicular to the ink ejection path; and a cover member having a first position removed from the print head and a second position substantially over the print head opposite the orifice region and the gutters for forming a sealed enclosure thereover defining a cavity sized to allow fluid flow therethrough from the first gutter over the orifice region to the second gutter.

2. The self-cleaning printer of claim 1, wherein the print head includes a pump having an outlet connected in fluid communication with the first gutter for delivering the cleaning fluid thereto.

3. The self-cleaning printer of claim 2, wherein the pump has an inlet connected in fluid communication with the second gutter for receiving the cleaning fluid therefrom.

4. The self-cleaning printer of claim 3, further comprising a filter disposed between the pump and one of the gutters for removing contaminants from the cleaning fluid.

5. The self-cleaning printer of claim 3, wherein the print head includes integral channels connecting the pump with the first and second gutters.

6. The self-cleaning printer of claim 1, wherein the print head includes a seal member extending around the gutters and the orifice region adapted for engaging the cover member for forming the sealed enclosure.

7. The self-cleaning printer of claim 1, further comprising a source of acoustic energy disposed for exciting the cleaning fluid in the sealed enclosure.

8. The self-cleaning printer of claim 7, wherein the source of acoustic energy is disposed on the cover member.

9. The self-cleaning printer of claim 7, wherein the source of acoustic energy comprises an ultrasonic transducer.

10. The self-cleaning printer of claim 1, wherein a portion of the orifice region is generally elongate, a portion of the first and second gutters being generally elongate and positioned substantially parallel to the generally elongate portion of the orifice region.

11. A self-cleaning printer comprising:

a print head having a surface thereon, the surface including an orifice region having at least one ink-ejection orifice defining an ink ejection path, a first gutter disposed on the surface proximate a first side of the orifice region, a second gutter disposed on the surface proximate a second side of the orifice region opposite the first side thereof, the first and second gutters being disposed on the print head substantially perpendicular to the ink ejection path, and a pump including an outlet connected in fluid communication with the first gutter and an inlet connected in fluid communication with the second gutter;

a cover member having a first position removed from the print head and a second position substantially over the print head opposite the orifice region of the surface and the gutters for forming an enclosure defining a cavity over the orifice region and the gutters sized to allow fluid flow from the first gutter over the orifice region to the second gutter; and a seal member positioned for forming a sealed condition around the cavity.

12. The self-cleaning printer of claim 11, further comprising a filter disposed between the pump and one of the gutters operable for removing contaminants from the cleaning fluid.

13. The self-cleaning printer of claim 11, wherein the seal member is an elastomeric gasket mounted to the print head.

14. The self-cleaning printer of claim 11, further comprising a source of acoustic energy disposed proximate the cavity for exciting the cleaning fluid therein.

15. The self-cleaning printer of claim 14, wherein the source of acoustic energy is disposed on the cover member.

16. The self-cleaning printer of claim 14, wherein the source of acoustic energy comprises an ultrasonic transducer.

17. The self-cleaning printer claim 11, wherein the pump is integrally formed on the print head.

18. The self-cleaning printer of claim 11, wherein the owlet and the inlet of the pump are channels integrally formed on the print head.

19. A method of assembling a self-cleaning printer, comprising the steps of:

providing a print head, the print head having a surface defining at least one orifice therethrough, the at least one orifice defining an ink ejection path, the at least one orifice being susceptible to obstruction by contaminants, a first gutter disposed on the surface proximate a first side of the at least one orifice, and a second gutter disposed on the surface proximate a second side of the at least one orifice opposite the first side, the first and second gutters being disposed on the print head substantially perpendicular to the ink ejection path, the first gutter being connected to a source of a cleaning fluid and the second gutter being connected to a receiver for the cleaning fluid;

providing a cover member corresponding in size and shape to a region of the surface including the at least one orifice, the first gutter and the second gutter, the cover member having a first position removed from the print head and a second position substantially over the print head; and removeably positioning the cover member in the second position opposite the region in sealed relation to the surface around the region defining a cavity therebetween for flow of the cleaning fluid from the first gutter over the at least one orifice to the second gutter.

20. The method of claim 19, wherein the source of the cleaning fluid includes a pump.

21. The method of claim 20, wherein the source of the cleaning fluid further includes a filter.

22. The method of claim 19, wherein the surface of the print head further includes a seal member extending around the at least one orifice, the first gutter and the second gutter for forming the sealed condition with the cover member.

23. The method of claim 19, comprising the further step of providing a source of acoustic energy for exciting the cleaning fluid when flowing from the first gutter to the second gutter.

* * * * *